US010030883B2

(12) United States Patent
Liu et al.

(10) Patent No.: US 10,030,883 B2
(45) Date of Patent: Jul. 24, 2018

(54) METHOD AND SYSTEM FOR MONITORING ABNORMALITY AT AIR OUTLET OF DEHUMIDIFIER

(71) Applicant: Gree Electric Appliances, Inc. of Zhuhai, Zhuhai, Guangdong (CN)

(72) Inventors: Wei Liu, Guangdong (CN); Yongchao Liang, Guangdong (CN); Peili Li, Guangdong (CN); Ding Yu, Guangdong (CN); Yuping Gao, Guangdong (CN); Pengyu Chen, Guangdong (CN); Yonghong Luo, Guangdong (CN); Zuqing Chen, Guangdong (CN); Qiyang Peng, Guangdong (CN); Chun Wang, Guangdong (CN); Jianqun Yang, Guangdong (CN)

(73) Assignee: GREE ELECTRIC APPLIANCES, INC. OF ZHUHAI (CN)

( * ) Notice: Subject to any disclaimer, the term of this patent is extended or adjusted under 35 U.S.C. 154(b) by 163 days.

(21) Appl. No.: 15/028,837

(22) PCT Filed: Sep. 9, 2014

(86) PCT No.: PCT/CN2014/086156

§ 371 (c)(1),
(2) Date: Apr. 12, 2016

(87) PCT Pub. No.: WO2015/051686

PCT Pub. Date: Apr. 16, 2015

(65) Prior Publication Data

US 2016/0258648 A1 Sep. 8, 2016

Related U.S. Application Data

(63) Continuation of application No. PCT/CN2014/086156, filed on Sep. 9, 2014.

(30) Foreign Application Priority Data

Oct. 12, 2013 (CN) ..... 2013 1 0476216

(51) Int. Cl.
*F24F 11/00* (2018.01)
*F24F 11/30* (2018.01)
(Continued)

(52) U.S. Cl.
CPC ..... *F24F 11/30* (2018.01); *F24F 3/1405* (2013.01); *F24F 11/00* (2013.01); *F24F 11/32* (2018.01);
(Continued)

(58) Field of Classification Search
CPC .... F24F 11/027; F24F 11/053; F24F 11/0079; F24F 11/04; F24F 2011/0045; F24F 2011/0052; F24F 3/1405; F24F 11/32
See application file for complete search history.

(56) References Cited

U.S. PATENT DOCUMENTS 5,226,285 A * 7/1993 Dankowski ..... F24F 1/0007 165/95
6,792,769 B2 * 9/2004 Trulaske, Sr. ..... F25B 47/00 165/232
(Continued)

FOREIGN PATENT DOCUMENTS

CN 101644634 2/2010
CN 101832612 9/2010
(Continued)

*Primary Examiner* — Devon Russell
(74) *Attorney, Agent, or Firm* — Colin P. Cahoon; James H. Ortega; Carstens & Cahoon, LLP

(57) ABSTRACT

A method and a system for monitoring an abnormality at an air outlet of a dehumidifier. The method comprises: identifying whether there is a blockage abnormality at the air outlet of the dehumidifier; after a blockage abnormality has been identified, starting a high wind-level operation of the
(Continued)

dehumidifier or controlling air deflectors of the dehumidifier to be reset; after the high wind-level operation has run for a set time period or after the air deflectors are reset, identifying whether the blockage abnormality has been eliminated; and after it has been identified that the blockage abnormality has not been eliminated, controlling the dehumidifier to stop running, and sending out a fault cue. The method and system disclosed can avoid influences on the operation, service life and reliability of the dehumidifier due to a long-term blockage at the air outlet of the dehumidifier.

11 Claims, 2 Drawing Sheets

(51) Int. Cl.

| | |
|---|---|
| *F24F 3/14* | (2006.01) |
| *F24F 110/12* | (2018.01) |
| *F24F 11/52* | (2018.01) |
| *F24F 110/20* | (2018.01) |
| *F24F 140/20* | (2018.01) |
| *F24F 11/32* | (2018.01) |

(52) U.S. Cl.
CPC ..... *F24F 11/52* (2018.01); *F24F 2003/144* (2013.01); *F24F 2003/1446* (2013.01); *F24F 2110/12* (2018.01); *F24F 2110/20* (2018.01); *F24F 2140/20* (2018.01)

(56) References Cited

U.S. PATENT DOCUMENTS

| | | | | |
|---|---|---|---|---|
| 9,366,451 | B2 * | 6/2016 | Guo | F24F 11/0009 |
| 2005/0251364 | A1 * | 11/2005 | Kang | G05B 9/02 702/183 |
| 2006/0080982 | A1 * | 4/2006 | Reichle | F25B 39/04 62/181 |
| 2010/0107668 | A1 * | 5/2010 | Voorhis | F24F 3/153 62/176.3 |
| 2010/0148748 | A1 * | 6/2010 | Bharadwaj | F24F 11/0086 324/71.1 |
| 2011/0093424 | A1 * | 4/2011 | Zimmermann | G05B 17/02 706/47 |
| 2013/0087302 | A1 * | 4/2013 | McKie | F28F 27/006 165/8 |
| 2013/0167567 | A1 * | 7/2013 | Fukui | F24F 11/008 62/115 |
| 2014/0238643 | A1 * | 8/2014 | Hains | F28G 9/00 165/95 |
| 2015/0330924 | A1 * | 11/2015 | Budde | G01K 7/42 374/142 |
| 2016/0061466 | A1 * | 3/2016 | Billman | F24F 1/0007 165/121 |

FOREIGN PATENT DOCUMENTS

| | | |
|---|---|---|
| CN | 102032650 | 4/2011 |
| CN | 202024438 | 11/2011 |
| CN | 202993394 | 6/2013 |
| CN | 203215872 | 9/2013 |
| JP | 2010271948 | 12/2010 |
| WO | 2008/034053 | 3/2008 |

* cited by examiner

METHOD AND SYSTEM FOR MONITORING ABNORMALITY AT AIR OUTLET OF DEHUMIDIFIER

CROSS REFERENCE TO RELATED APPLICATIONS

This application is a continuation application of PCT Patent Application No. PCT/CN2014/086156, entitled "Method and System for Monitoring Abnormality at Air Outlet of Dehumidifier", filed on Sep. 9, 2014, which claims priority to Chinese Patent Application No. 201310476216.0, entitled "Method and System for Monitoring Abnormality at Air Outlet of Dehumidifier", filed on Oct. 12, 2013, the entire contents of which are incorporated herein by reference.

TECHNICAL FIELD

The present disclosure relates to the technical field of a dehumidifier, more particularly, to a method and a system for monitoring an abnormality at an air outlet of a dehumidifier.

BACKGROUND

When a prior art dehumidifier operates, a blockage abnormality at the air outlet often occurs due to external environmental conditions or for the reason that the air deflectors cannot open normally. If the abnormality is not found out or not dealt with timely, as for a slight blockage abnormality at the air outlet of the dehumidifier, it will accelerate the aging rates of the compressor and the air outlet of the dehumidifier over the time, thereby reducing the service life of the dehumidifier; as for a severe blockage abnormality at the air outlet, it will directly threaten the operation of the dehumidifier, causing the dehumidifier to break down, decreasing the reliability of the dehumidifier, or even causing potential safety hazards of the dehumidifier. Therefore, how to avoid the product malfunction caused by the blockage at the air outlet of the dehumidifier has become a problem to be solved urgently.

SUMMARY OF THE INVENTION

In view of the situations, in order to overcome the defects and deficiency in the prior art, it is necessary to provide a method and a system for monitoring an abnormality at an air outlet of a dehumidifier, which can timely identify and eliminate a blockage abnormality at the air outlet of the dehumidifier in operation, thereby avoiding bad consequences caused by the blockage abnormality at the air outlet of the dehumidifier.

In order to achieve the objectives of the present invention, a method for monitoring an abnormality at an air outlet of a dehumidifier is provided, comprising following steps:

S100, identifying whether there is a blockage abnormality at the air outlet of the dehumidifier;

S200, after a blockage abnormality at the air outlet has been identified, starting a high wind-level operation of the dehumidifier or controlling air deflectors of the dehumidifier to be reset;

S300, after the high wind-level operation has run for a set time period or after the air deflectors are reset, returning to step S100 to identify whether the blockage abnormality is eliminated or not;

S400, after it is identified that the blockage abnormality is not eliminated, controlling the dehumidifier to stop running, and sending out a fault cue.

In one of the embodiments, the step S100 comprises following sub-steps:

S110, detecting environmental temperature and temperature of an evaporator pipe during running of the dehumidifier;

S120, judging whether a variation tendency of the temperature of the evaporator pipe meets a preset condition or not;

S130, if yes, calculating a difference between current environmental temperature and the temperature of the evaporator pipe, and comparing the difference between the current environmental temperature and the temperature of the evaporator pipe with a preset temperature difference;

S140, if the difference between the current environmental temperature and the temperature of the evaporator pipe is less than the preset temperature difference, going to step S200.

In one of the embodiments, the preset condition is as follows: after the temperature of the evaporator pipe has decreased by the a preset temperature amplitude during a first preset time, the temperature of the evaporator pipe increases by a second preset temperature amplitude during a second preset time.

In one of the embodiments, the first preset time is ranged from 1 to 3 minutes; the first preset temperature amplitude is ranged from 3° C. to 6° C.; the second preset time is ranged from 4 to 6 minutes; and the second preset temperature amplitude is ranged from 3° C. to 7° C.

In one of the embodiments, the preset temperature difference is ranged from 4° C. to 8° C.

Correspondingly, the present disclosure provides a system for monitoring an abnormality at an air outlet of a dehumidifier. The system comprises a first identifying module, a malfunction eliminating module, a second identifying module and a sudden halt control module;

the first identifying module is configured to identify whether there is a blockage abnormality at the air outlet of the dehumidifier;

the malfunction eliminating module is configured to, after a blockage abnormality at the air outlet is identified, start a high wind-level operation of the dehumidifier or control air deflectors of the dehumidifier to be reset;

the second identifying module is configured to, after the high wind-level operation has run for a set time period or after the air deflectors are reset, control the first identifying module to identify whether the blockage abnormality has been eliminated or not;

the sudden halt control module is configured to, after it is identified that the blockage abnormality is not eliminated, control the dehumidifier to stop running and send out a fault cue.

In one of the embodiments, the first identifying module comprises a detecting unit, a judging unit, a comparing unit and an identifying unit;

the detecting unit is configured to detect environmental temperature and temperature of an evaporator pipe during running of the dehumidifier;

the judging unit is configured to judge whether a variation tendency of the temperature of the evaporator pipe meets a preset condition or not;

the comparing unit is configured to, if it is judged by the judging unit that the variation tendency of the temperature of the evaporator pipe meets the preset condition, calculate a difference between current environmental temperature and the temperature of the evaporator pipe, and comparing the difference between the current environmental temperature and the temperature of the evaporator pipe with the preset temperature difference;

the identifying unit is configured to start the malfunction eliminating module, if the difference between the current environmental temperature and the temperature of the evaporator pipe is less than the preset temperature difference.

In one of the embodiments, the preset condition is as follows: after the temperature of the evaporator pipe has decreased by a first preset temperature amplitude during a first preset time, the temperature of the evaporator pipe increases by a second preset temperature amplitude during a second preset time.

In one of the embodiments, the first preset time is ranged from 1 to 3 minutes; the first preset temperature amplitude is ranged from 3° C. to 6° C.; the second preset time is ranged from 4 to 6 minutes; and the second preset temperature amplitude is ranged from 3° C. to 7° C.

In one of the embodiments, the preset temperature difference is ranged from 4° C. to 8° C.

The beneficial effects of the present invention are as follows: The present disclosure provides a method and a system for monitoring an abnormality at an air outlet of a dehumidifier. After the blockage abnormality at the air outlet is identified, the dehumidifier is started to operate at a high wind-level or the air deflectors of the dehumidifier are controlled to be reset, and the malfunction is eliminated; if the malfunction cannot be eliminated automatically, the dehumidifier is controlled to stop running timely and a fault cue is sent to the user. Thereby, the blockage abnormality at the air outlet of the dehumidifier can be identified timely, and the abnormality can be eliminated timely after the abnormality is identified, avoiding influences on the operation, service life and reliability of the dehumidifier due to a long-term blockage at the air outlet of the dehumidifier.

BRIEF DESCRIPTION OF THE DRAWINGS

In order to make the objectives, the technical schemes and the advantages of the present invention more clear and be understood, the method and the system for monitoring an abnormality at an air outlet of a dehumidifier of the present invention will be described in more details with reference to the accompanying figures and embodiments.

DETAILED DESCRIPTION OF THE PREFERRED EMBODIMENTS

Figure 1:
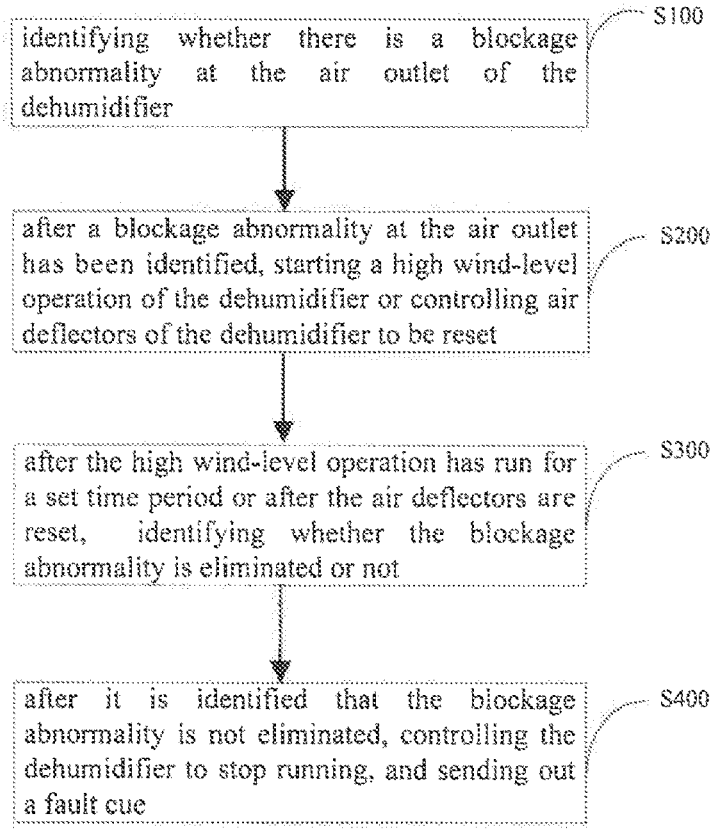
FIG. 1 is a flow chart illustrating the method for monitoring an abnormality at an air outlet of a dehumidifier according to one embodiment of the present invention.
Figure 2:
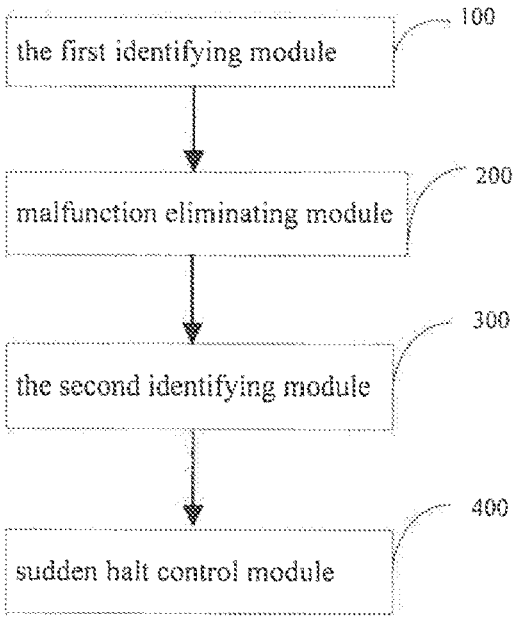
FIG. 2 is a structural schematic diagram illustrating the system for monitoring an abnormality at an air outlet of a dehumidifier according to one embodiment of the present invention.
Figure 3:
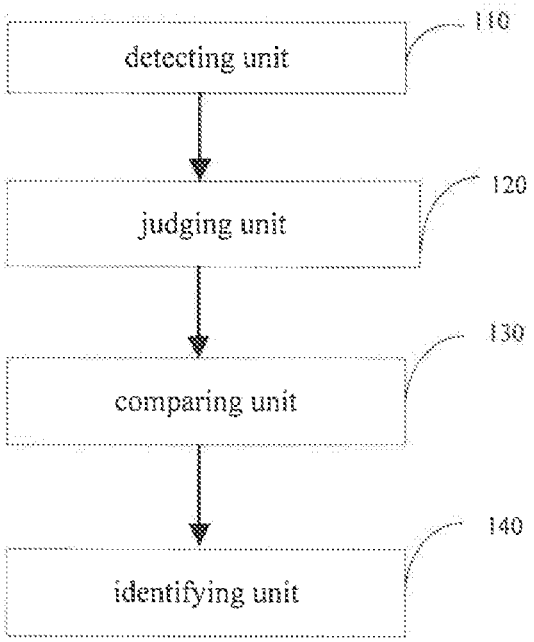
FIG. 3 is a structural schematic diagram illustrating the first identifying module of the system for monitoring an abnormality at an air outlet of a dehumidifier shown in FIG. 2.

The method and the system for monitoring an abnormality at an air outlet of a dehumidifier according to embodiments of the present invention are shown in FIGS. 1-3.

As shown in FIG. 1, according to one embodiment of the present invention, the method for monitoring an abnormality at an air outlet of a dehumidifier comprises the steps as follows:

S100, identify whether there is a blockage abnormality at the air outlet of the dehumidifier. During the running of the dehumidifier, once there is a blockage abnormality at the air outlet, the temperature of the evaporator pipe varies significantly relative to the environmental temperature. Through detecting the environmental temperature and the temperature of the evaporator pipe of the dehumidifier in operation, the blockage abnormality at the air outlet can be identified timely and accurately.

S200, after a blockage abnormality at the air outlet has been identified, start a high wind-level operation of the dehumidifier or control the air deflectors of the dehumidifier to be reset.

Generally, the blockage abnormality at the air outlet is caused by the reasons that, during a long time period of running of the dehumidifier, the dust or sundries fall into the air outlet from the external environment, or the air outlet is shielded by other objects, causing the blockage abnormality at the air outlet. Through starting the high wind-level operation of the dehumidifier, the air volume for heat exchange at the high-pressure side is increased, thereby the dust or the sundries at the air outlet is blown away, or the obstructions are blown away, and the malfunction caused by the blockage abnormality at the air outlet is eliminated. Currently, more and more dehumidifier products are provided with a motion mechanism for air deflectors at the air outlet of the dehumidifier. As for the dehumidifier provided with air deflectors, if the air deflectors cannot open 90 degrees, or if the air deflectors open too small angles or even close completely due to external factors during the running of the dehumidifier, which are equivalent to the situation that the air outlet becomes less opened, the air deflectors will effect as obstructions that block the air outlet, thereby causing a blockage abnormality at the air outlet. Typically, if the air deflectors are closed due to human factors or due to other abnormalities, causing the blockage of the air outlet, the malfunction can be eliminated by controlling the air deflectors to perform a full reset action.

S300, after the high wind-level operation has run for a set time period or after the air deflectors are reset, return to the step S100 to identify whether the blockage abnormality has been eliminated or not. After the malfunction eliminating action is performed, it should be further confirmed whether the malfunction has been eliminated.

S400, if it is identified that the blockage abnormality is not eliminated, control the dehumidifier to stop running and send out a fault cue. As for a severe blockage abnormality at the air outlet, the malfunction cannot be eliminated by the dehumidifier itself, and human involvements are needed. Before eliminating the malfunction, control the dehumidifier to stop running so as to reduce influences on the equipment itself.

The prior art dehumidifier cannot identify an abnormality at the air outlet thereof, therefore, the abnormality cannot be eliminated timely, and the dehumidifier has to rely on the overloading of the compressor as the final overload protection. According to the method and the system for monitoring an abnormality at an air outlet of a dehumidifier as illustrated in embodiments of the present invention, a blockage abnormality at the air outlet can be identified timely, then the dehumidifier is started to operate at a high wind-level or the air deflectors of the dehumidifier are controlled to be reset, and the malfunction is eliminated; if the malfunction cannot be eliminated automatically, the dehumidifier is controlled to stop running timely and a fault cue is sent to the user. Thereby, the blockage abnormality at the air outlet of the dehumidifier can be identified timely, and the abnormality can be eliminated timely after the abnormality is identified, avoiding influences on the operation, service life and reliability of the dehumidifier due to a long-term blockage at the air outlet of the dehumidifier.

Preferably, in one of the embodiments, the step S100 comprises following sub-steps:

S110, detecting the environmental temperature and the temperature of the evaporator pipe during the running of the dehumidifier;

S120, judging whether the variation tendency of the temperature of the evaporator pipe meets the preset condition or not;

S130, if yes, calculating the difference between the current environmental temperature and the temperature of the evaporator pipe, and comparing the difference between the current environmental temperature and the temperature of the evaporator pipe with the preset temperature difference;

S140, if the difference between the current environmental temperature and the temperature of the evaporator pipe is less than the preset temperature difference, going to step S200.

During the running of the dehumidifier, once a blockage abnormality at the air outlet occurs, the temperature of the evaporator pipe varies significantly relative to the environmental temperature. Therefore, through detecting the environmental temperature and the temperature of the evaporator pipe during the running of the dehumidifier, the method for monitoring an abnormality at an air outlet of a dehumidifier according to embodiments of the present invention can identify the blockage abnormality at the air outlet timely and accurately.

Further, the preset condition is as follows: after the temperature of the evaporator pipe has decreased by the first preset temperature amplitude during the first preset time, the temperature of the evaporator pipe increases by the second preset temperature amplitude during the second preset time. During the actual operation of the dehumidifier, when the compressor is started to run continuously, once an abnormality occurs at the air outlet, the temperature of the evaporator pipe will be subject to a variation process of decreasing instantaneously and then increasing continuously. When an increase tendency of the temperature of the evaporator pipe is detected continuously, judge whether the difference between the current environmental temperature and the temperature of the evaporator pipe exceeds the preset temperature difference, wherein, said preset temperature difference is the limit temperature difference for the reliable running of the dehumidifier. If exceeds, it is judged that there is an abnormality at the air outlet.

Further, the first preset time is ranged from 1 to 3 minutes; the first preset temperature amplitude is ranged from 3° C. to 6° C.; the second preset time is ranged from 4 to 6 minutes; the second preset temperature amplitude is ranged from 3° C. to 7° C.

Preferably, the preset temperature difference is ranged from 4° C. to 8° C.

It should be noted that, the time ranges and the corresponding temperature variation amplitudes in the preset condition above are all obtained through a large number of experiments. As an example, an experiment is done under the usual environmental condition, where the temperature is 25° C. and the relative humidity is 80%, to verify the effect of the present disclosure in case that the air outlet is completely blocked suddenly during the operation of the dehumidifier, and the experiment is described as follows:

Completely block the air outlet of the dehumidifier within the first minute, and the system overload protection will be activated in 13 minutes after the air outlet is blocked. After the air outlet is blocked, the temperature of the evaporator pipe is subject to a variation process of decreasing instantaneously and then increasing continuously, that is, decreasing from 13° C. to 7° C. within two minutes. Before the compressor stops running due to the overload protection, the temperature of the evaporator pipe has increased from the lowest temperature 7° C. to 29° C. within about 10 minutes. Within the following 5 minutes, the difference between the current environmental temperature and the temperature of the evaporator pipe is always higher than 6° C.

Within a period of time (the preset time) after the dehumidifier has performed the malfunction eliminating action automatically, if it is identified that the difference between the environmental temperature and the temperature of the evaporator pipe is still less than 6° C., stop the dehumidifier directly, send out a buzzer sound and display a fault code to prompt the user to check whether there is an abnormality or malfunction at the air outlet.

Based on the same invention conception, the present disclosure further provides a system for monitoring an abnormality at an air outlet of a dehumidifier correspondingly. As the principle of the system for solving problems is similar to that of the method for monitoring an abnormality at an air outlet of a dehumidifier, and the implementation of the system can be realized through the specific process of the method mentioned above, the similarities will not be described again.

According to the present disclosure, the system for monitoring an abnormality at an air outlet of a dehumidifier, as shown in FIG. 2, comprises a first identifying module 100, a malfunction eliminating module 200, a second identifying module 300 and a sudden halt control module 400.

The first identifying module 100 is configured to identify whether there is a blockage abnormality at the air outlet of the dehumidifier.

The malfunction eliminating module 200 is configured to, after a blockage abnormality at the air outlet has been identified, start a high wind-level operation of the dehumidifier or control air deflectors of the dehumidifier to be reset.

The second identifying module 300 is configured to, after the high wind-level operation has run for a set time period, or after the air deflectors are reset, control the first identifying module 100 to identify whether the blockage abnormality has been eliminated.

The sudden halt control module 400 is configured to, after it is identified that the blockage abnormality is not eliminated, control the dehumidifier to stop running and send out a fault cue.

Preferably, as one of the embodiments shown in FIG. 3, the first identifying module 100 comprises a detecting unit 110, a judging unit 120, a comparing unit 130 and an identifying unit 140.

The detecting unit 110 is configured to detect the environmental temperature and the temperature of the evaporator pipe during the running of the dehumidifier.

The judging unit 120 is configured to judge whether the variation tendency of the temperature of the evaporator pipe meets the preset condition or not.

The comparing unit 130 is configured to, if it is judged by the judging unit 120 that the variation tendency of the temperature of the evaporator pipe meets the preset condition, calculate the difference between the current environmental temperature and the temperature of the evaporator pipe, and compare the difference between the current environmental temperature and the temperature of the evaporator pipe with the preset temperature difference.

The identifying unit 140 is configured to start the malfunction eliminating module 200 if the difference between the current environmental temperature and the temperature of the evaporator pipe is less than the preset temperature difference.

Further, the preset condition is as follows: after the temperature of the evaporator pipe has decreased by the first preset temperature amplitude during the first preset time, the temperature of the evaporator pipe increases by the second preset temperature amplitude during the second preset time.

Further, the first preset time is ranged from 1 to 3 minutes; the first preset temperature amplitude is ranged from 3° C. to 6° C.; the second preset time is ranged from 4 to 6 minutes; the second preset temperature amplitude is ranged from 3° C. to 7° C.

Preferably, the preset temperature difference is ranged from 4° C. to 8° C.

Through detecting the environmental temperature and the temperature of the evaporator pipe, the method and the system for monitoring an abnormality at an air outlet of a dehumidifier according to embodiments of the present invention can identify the blockage abnormality at the air outlet timely and accurately. Furthermore, through starting the high wind-level operation of the dehumidifier, the malfunction is eliminated. If the malfunction cannot be eliminated automatically, the dehumidifier is controlled to stop running and prompts the user with an alarm. The present invention can identify the blockage abnormality at the air outlet of the dehumidifier timely, and eliminate the malfunction after the abnormality is identified, thereby avoiding influences on the operation, service life and reliability of the dehumidifier due to a long-term blockage of the air outlet of the dehumidifier.

What described above are several embodiments of the present invention, and they are specific and in details, but not intended to limit the scope of the present invention. It will be understood by those skilled in the art that various modifications and improvements can be made without departing from the conception of the present disclosure, and all these modifications and improvements are within the scope of the present invention. Therefore, the scope of the present invention should be subject to the claims attached.

What is claimed is:

1. A method for monitoring an abnormality at an air outlet of a dehumidifier, comprising following steps:

S100, identifying whether there is a blockage abnormality at the air outlet of the dehumidifier;

S200, after a blockage abnormality at the air outlet has been identified, starting a high wind-level operation of the dehumidifier or controlling air deflectors of the dehumidifier to be reset;

S300, after the high wind-level operation has run for a set time period, or after the air deflectors are reset, returning to step S100 to identify whether the blockage abnormality has been eliminated or not; and S400, after it is identified that the blockage abnormality is not eliminated, controlling the dehumidifier to stop running, and sending out a fault cue;

wherein, step S100 comprises following sub-steps:

S110, detecting environmental temperature and temperature of an evaporator pipe during running of the dehumidifier;

S120, judging whether a variation of temperature of the evaporator pipe meets a preset condition or not wherein, the preset condition is as follows: after the temperature of the evaporator pipe has decreased by a first preset temperature amplitude during a first preset time, the temperature of the evaporator pipe increases by a second preset temperature amplitude during a second preset time;

S130, if yes, calculating a difference between current environmental temperature and the temperature of the evaporator pipe, and comparing the difference between the current environmental temperature and the temperature of the evaporator pipe with a preset temperature difference; and S140, if the difference between the current environmental temperature and the temperature of the evaporator pipe is less than the preset temperature difference, going to step S200.

2. The method for monitoring an abnormality at an air outlet of a dehumidifier according to claim 1, wherein, the first preset time is within the range of 1 to 3 minutes; the first preset temperature amplitude is within the range of 3° C. to 6° C.; the second preset time is within the range of 4 to 6 minutes; and the second preset temperature amplitude is within the range of 3° C. to 7° C.

3. The method for monitoring an abnormality at an air outlet of a dehumidifier according to claim 1, wherein, the preset temperature difference is within the range of 4° C. to 8° C.

4. The method for monitoring an abnormality at an air outlet of a dehumidifier according to claim 2, wherein, the preset temperature difference is within the range of 4° C. to 8° C.

5. A system for monitoring an abnormality at an air outlet of a dehumidifier, comprising a first identifying module, a malfunction eliminating module, a second identifying module and a sudden halt control module;

the first identifying module is configured to identify whether there is a blockage abnormality at the air outlet of the dehumidifier by:

detecting environmental temperature and temperature of an evaporator pipe during running of the dehumidifier;

judging whether a variation of temperature of the evaporator pipe meets a preset condition or not wherein, the preset condition is as follows: after the temperature of the evaporator pipe has decreased by a first preset temperature amplitude during a first preset time, the temperature of the evaporator pipe increases by a second preset temperature amplitude during a second preset time;

if said preset condition is met, calculating a difference between current environmental temperature and the temperature of the evaporator pipe, and comparing the difference between the current environmental temperature and the temperature of the evaporator pipe with a preset temperature difference; and if the difference between the current environmental temperature and the temperature of the evaporator pipe is less than the preset temperature difference, the malfunction eliminating module is configured to, after a blockage abnormality at the air outlet has been identified, start a high wind-level operation of the dehumidifier or control air deflectors of the dehumidifier to be reset;

the second identifying module is configured to, after the high wind-level operation has run for a set time period or after the air deflectors are reset, control the first identifying module to identify whether the blockage abnormality has been eliminated or not; and the sudden halt control module is configured to, after it is identified that the blockage abnormality is not eliminated, control the dehumidifier to stop running and send out a fault cue.

6. The system for monitoring an abnormality at an air outlet of a dehumidifier according to claim 5, wherein, the first identifying module comprises a detecting unit, a judging unit, a comparing unit and an identifying unit;

the detecting unit is configured to detect environmental temperature and temperature of an evaporator pipe during running of the dehumidifier;

the judging unit is configured to judge whether a variation of temperature of the evaporator pipe meets a preset condition or not;

the comparing unit is configured to, if it is judged by the judging unit that the variation of temperature of the evaporator pipe meets the preset condition, calculate a difference between current environmental temperature and the temperature of the evaporator pipe, and comparing the difference between the current environmental temperature and the temperature of the evaporator pipe with the preset temperature difference;

the identifying unit is configured to start the malfunction eliminating module, if the difference between the current environmental temperature and the temperature of the evaporator pipe is less than the preset temperature difference.

7. The system for monitoring an abnormality at an air outlet of a dehumidifier according to claim 6, wherein, the preset condition is as follows: after the temperature of the evaporator pipe has decreased by a first preset temperature amplitude during a first preset time, the temperature of the evaporator pipe increases by a second preset temperature amplitude during a second preset time.

8. The system for monitoring an abnormality at an air outlet of a dehumidifier according to claim 7, wherein, the first preset time is within the range of 1 to 3 minutes; the first preset temperature amplitude is within the range of 3° C. to 6° C.; the second preset time is within the range of 4 to 6 minutes; and the second preset temperature amplitude is within the range of 3° C. to 7° C.

9. The system for monitoring an abnormality at an air outlet of a dehumidifier according to claim 6, wherein, the preset temperature difference is within the range of 4° C. to 8° C.

10. The system for monitoring an abnormality at an air outlet of a dehumidifier according to claim 7, wherein, the preset temperature difference is within the range of 4° C. to 8° C.

11. The system for monitoring an abnormality at an air outlet of a dehumidifier according to claim 8, wherein, the preset temperature difference is within the range of 4° C. to 8° C.

* * * * *